US011149470B2

(12) United States Patent
Markiewicz

(10) Patent No.: US 11,149,470 B2
(45) Date of Patent: Oct. 19, 2021

(54) KEY ROTOR FOR USE WITH MANUAL KEY SWITCHES

(71) Applicant: Mark Thomas Markiewicz, Haymarket, VA (US)

(72) Inventor: Mark Thomas Markiewicz, Haymarket, VA (US)

( * ) Notice: Subject to any disclaimer, the term of this patent is extended or adjusted under 35 U.S.C. 154(b) by 419 days.

(21) Appl. No.: 16/282,185

(22) Filed: Feb. 21, 2019

(65) Prior Publication Data

US 2019/0257119 A1 Aug. 22, 2019

Related U.S. Application Data

(60) Provisional application No. 62/633,361, filed on Feb. 21, 2018.

(51) Int. Cl.

| | |
|---|---|
| ***E05B 49/00*** | (2006.01) |
| ***A45C 11/32*** | (2006.01) |
| ***G07C 9/00*** | (2020.01) |

(52) U.S. Cl.

CPC ..... *E05B 49/006* (2013.01); *A45C 11/325* (2013.01); *G07C 9/00944* (2013.01); *E05B 49/004* (2013.01); *G07C 9/00904* (2013.01); *G07C 2009/00952* (2013.01); *G07C 2009/00992* (2013.01)

(58) Field of Classification Search

CPC ... E05B 49/006; E05B 49/004; A45C 11/325; G07C 9/00944

USPC ..... 70/344

See application file for complete search history.

(56) References Cited

U.S. PATENT DOCUMENTS

| | | | | |
|---|---|---|---|---|
| 4,895,485 | A * | 1/1990 | Guevara | F16B 39/06 411/110 |
| 4,910,983 | A | 3/1990 | Taylor | |
| 6,196,038 | B1 * | 3/2001 | Chappoux | E05B 29/004 70/356 |
| 8,511,121 | B2 * | 8/2013 | Tsuruta | B60R 25/243 70/337 |
| 8,992,149 | B2 * | 3/2015 | Dixon | F16B 39/06 411/322 |
| 2002/0072437 | A1 * | 6/2002 | Shaw | A63C 19/06 473/490 |
| 2005/0141982 | A1 * | 6/2005 | Schultz | F16B 39/06 411/178 |

(Continued)

FOREIGN PATENT DOCUMENTS

JP 2010077613 A 4/2010

*Primary Examiner* — Kerri L McNally

(57) ABSTRACT

A key holder designed for use with manual key switches affixes a key onto a control box. The key holder includes a rotor housing, a key rotor, and a threaded opening. The key is mounted into the key rotor before being inserted into the control box. Further, the key rotor is rotatably mounted into the rotor housing via the threaded opening. The key rotor includes an interior face, an exterior face, a threaded body, and a key slot. The interior face and exterior face are positioned opposite each other about the threaded body. The key slot traverses through the threaded body. To connect the key rotor to the rotor housing, the threaded body is screwed into the threaded opening. This transforms the rotational motion into the linear motion of the key rotor, which along with the locking feature of the manual key switch, prevents the key from rotating.

16 Claims, 6 Drawing Sheets

(56) References Cited

U.S. PATENT DOCUMENTS

| | | | | |
|---|---|---|---|---|
| 2009/0000343 | A1* | 1/2009 | Giacomin | A45C 11/327 70/456 R |
| 2013/0145804 | A1* | 6/2013 | Yamakage | E05B 29/0033 70/492 |

* cited by examiner

KEY ROTOR FOR USE WITH MANUAL KEY SWITCHES

The current application claims a priority to the U.S. Provisional Patent application Ser. No. 62/633,361 filed on Feb. 21, 2018.

FIELD OF THE INVENTION

The present invention generally relates to a key holder for user with manual key switches. More specifically, the present invention holds a key in a tilted position by disabling the rotation mechanism employed in manual key switches.

BACKGROUND OF THE INVENTION

The present invention is designed to be used with manual key switches. In the preferred implementation, the present invention enables teachers and coaches to operate the basketball hoops or partition walls in a gymnasium without taking their eyes off the students. More specifically, the present invention eliminates the need of holding the key in place while the mechanical functions of raising or lowering the basketball hoops or partitions take place, as is currently required. Further, the present invention provides several key benefits such as providing a device designed to hold the key in place while using a key switch. This also eliminates the need for the user to hold the key in place while using the key switch. As such, this also saves valuable time which allows teachers and coaches to multi-task.

To achieve this, the present invention includes a key rotor and a rotor housing. The key is releasably mounted into the key rotor. Finger grooves are provided on the key rotor to allow the user to securely rotate the key. The key rotor is rotatably mounted into a threaded opening that traverses through the rotor housing. The screw connection between the threaded opening and the key rotor transforms rotational motion of the key into linear motion of the key rotor. This prevents the key from rotating in either the clockwise or counter-clockwise direction, thereby holding the key in position while the manual key switch is activated.

DETAILED DESCRIPTION OF THE INVENTION

All illustrations of the drawings are for the purpose of describing selected versions of the present invention and are not intended to limit the scope of the present invention.

The present invention is a key holder designed for control boxes used to raise or lower the retractable basketball hoops or partition dividers in a gymnasium. Preferably, present invention is mounted onto the manual key switch on the control box. Usually, the manual key switches require a person to hold the key while the basketball hoops or partition dividers are in the process of raising or lowering. The present invention prevents the key from rotating back to the straight position, thus eliminating the need for the person to hold the key in position.

Figure 1:
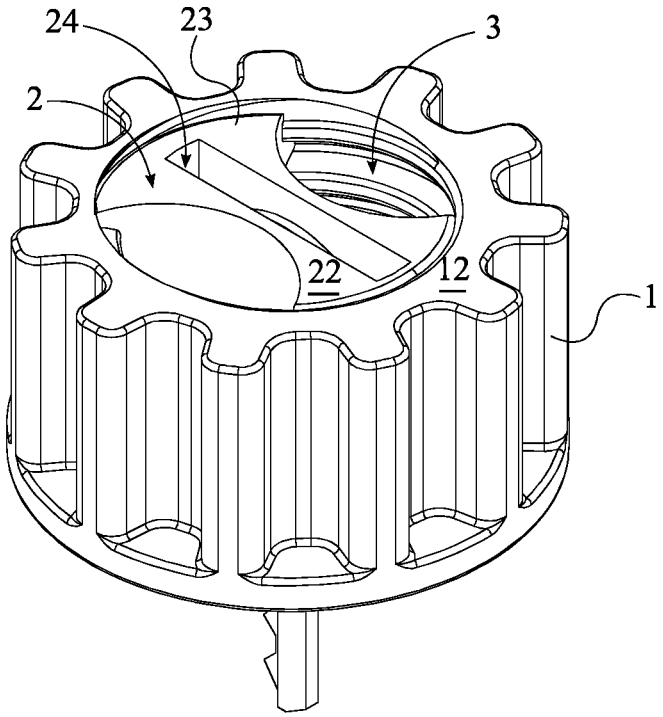
FIG. 1 is a top perspective view of the present invention.
Figure 2:
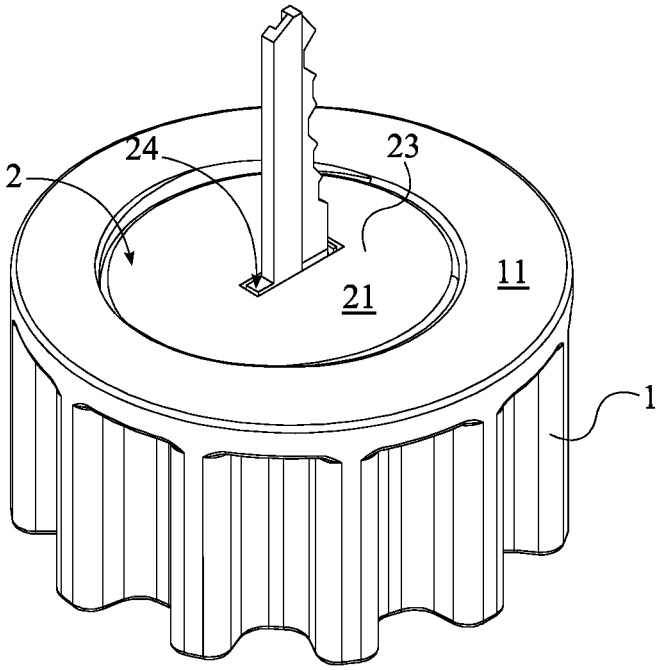
FIG. 2 is a bottom perspective view of the present invention.

Referring to FIG. 1 and FIG. 2, the preferred embodiment of the present invention comprises a rotor housing 1, a key rotor 2, and a threaded opening 3. The key rotor 2 is a rotating component which holds the key for the manual key switch. Preferably, the threaded body 23 is rotatably engaged within the threaded opening 3. Accordingly, the rotor housing 1 can selectively prevent the key rotor 2 from rotating, thus locking the key in a fixed position. The threaded opening 3 concentrically traverses through the rotor housing 1. Preferably, the key rotor 2 is rotatably engaged to the rotor housing 1 via the threaded opening 3. The preferred embodiment the key rotor 2 comprises an interior face 21, an exterior face 22, a threaded body 23, and a key slot 24. To prevent the threaded body 23 from separating from the threaded opening 3, the threaded body 23 is screwed into the threaded opening 3. This forms an interlocking engagement between the threaded body 23 and the threaded opening 3 which transforms rotational movement to linear movement. Thus, the threaded body 23 traverses into or out of the rotor housing 1 depending on the direction of rotation. In the preferred embodiment of the present invention, a clockwise rotation causes the threaded body 23 to move into the rotor housing 1 and a counter-clockwise rotation causes the threaded body 23 to move out of the rotor housing 1.

The interior face 21 and the exterior face 22 are positioned opposite each other about the threaded body 23. As the name implies, the interior face 21 is positioned facing towards the control box. In contrast, the exterior face 22 is positioned facing away from the control box. In the preferred embodiment, the key slot 24 is customized to fit the key used in manual key switches. As such, the key slot 24 concentrically traverses through the threaded body 23 from the exterior face 22 to the interior face 21. Thus, the key slot 24 is accessible to the user while the threaded body 23 is attached to the manual key switch.

Figure 3:
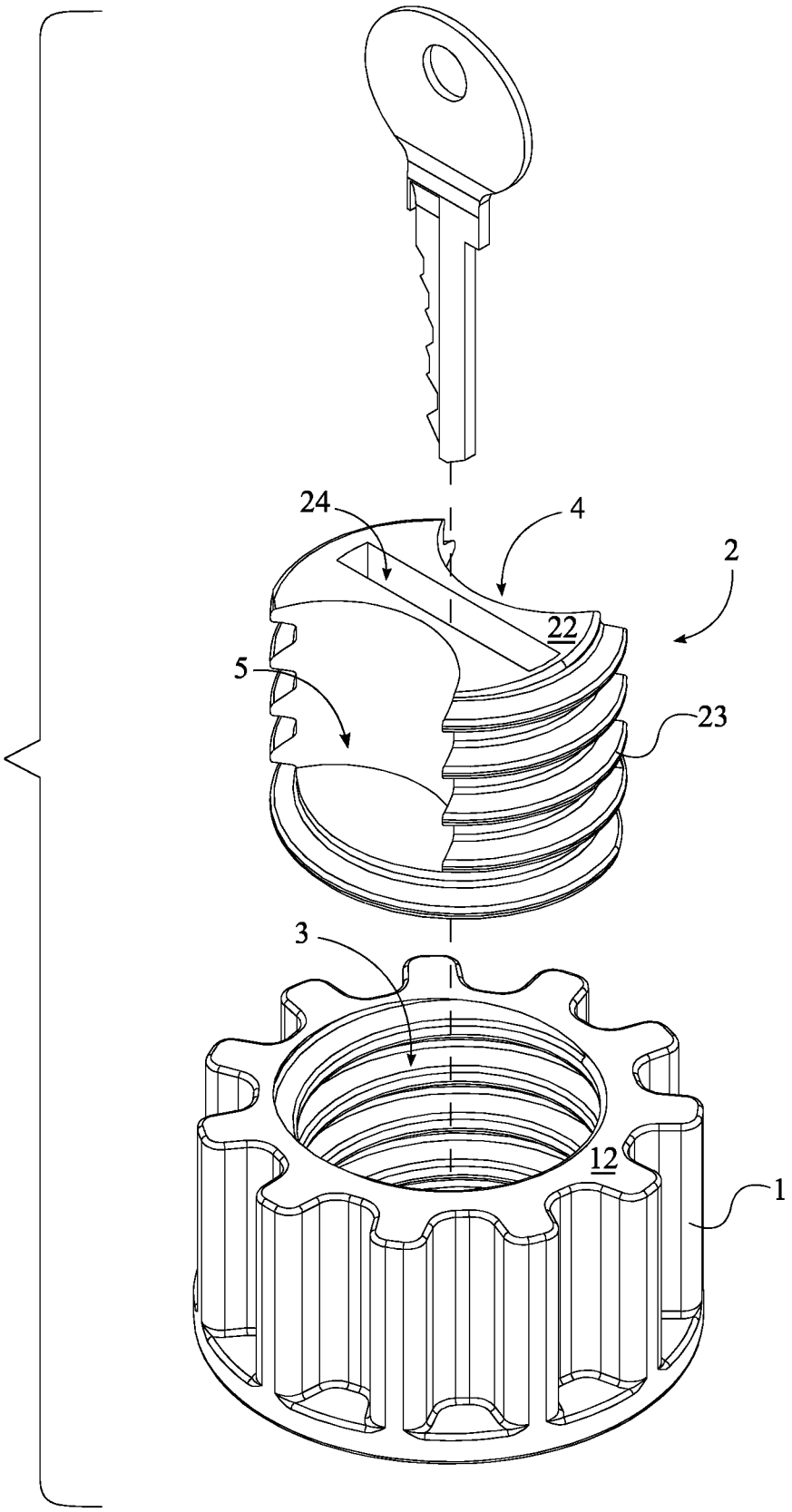
FIG. 3 is a top perspective exploded view showing the key, the key rotor, and the rotor housing.

Referring to FIG. 3, the present invention further comprises a first finger slot 4 and a second finger slot 5 that are provided to help the user grip onto the threaded body 23. In the preferred embodiment, the first finger slot 4 and the second finger slot 5 are circular cuts sized to fit around the fingers of the user. As such, the first finger slot 4 traverses laterally into the threaded body 23 from the exterior face 22. Similarly, the second finger slot 5 laterally traverses into the threaded body 23 from the exterior face 22. This allows the user to access the first finger slot 4 and the second finger slot 5 while the threaded body 23 is engaged to the rotor housing 1. In the preferred embodiment, the first finger slot 4 and the second finger slot 5 are configured to allow the user to pinch the threaded body 23 between the fingers. As such, the first finger slot 4 and the second finger slot 5 are diametrically opposed of each other about the key slot 24. More specifically, the first finger slot 4 is positioned adjacent to the key slot 24. Similarly, the second finger slot 5 is positioned adjacent to the key slot 24, opposite the first finger slot 4. This allows the user to exert substantial force on the threaded body 23 without the threaded body 23 slipping out of the user's grasp.

Figure 4:
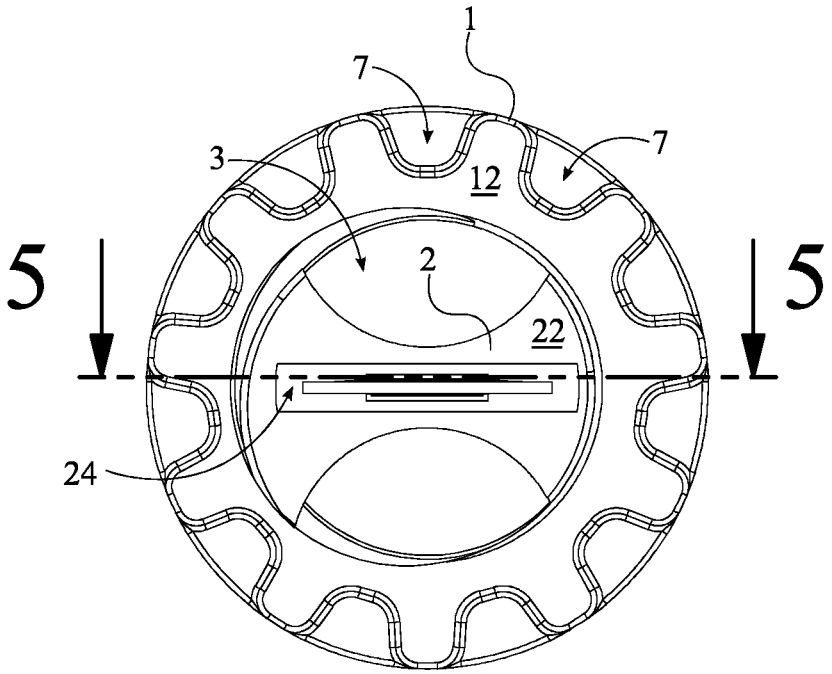
FIG. 4 is a top plan view of the present invention.

Referring to FIG. 4, the present invention further comprises a plurality of grooves 7 that enables the user to securely grip the rotor housing 1. As such, the plurality of grooves 7 is radially positioned about the rotor housing 1. More specifically, the each of the plurality of grooves 7 is positioned along the perimeter of the rotor housing 1. Further, the plurality of grooves 7 laterally traverses into the rotor housing 1. More specifically, each of the plurality of grooves 7 is a circular cut made into the side of the rotor housing 1.

Figure 5A:
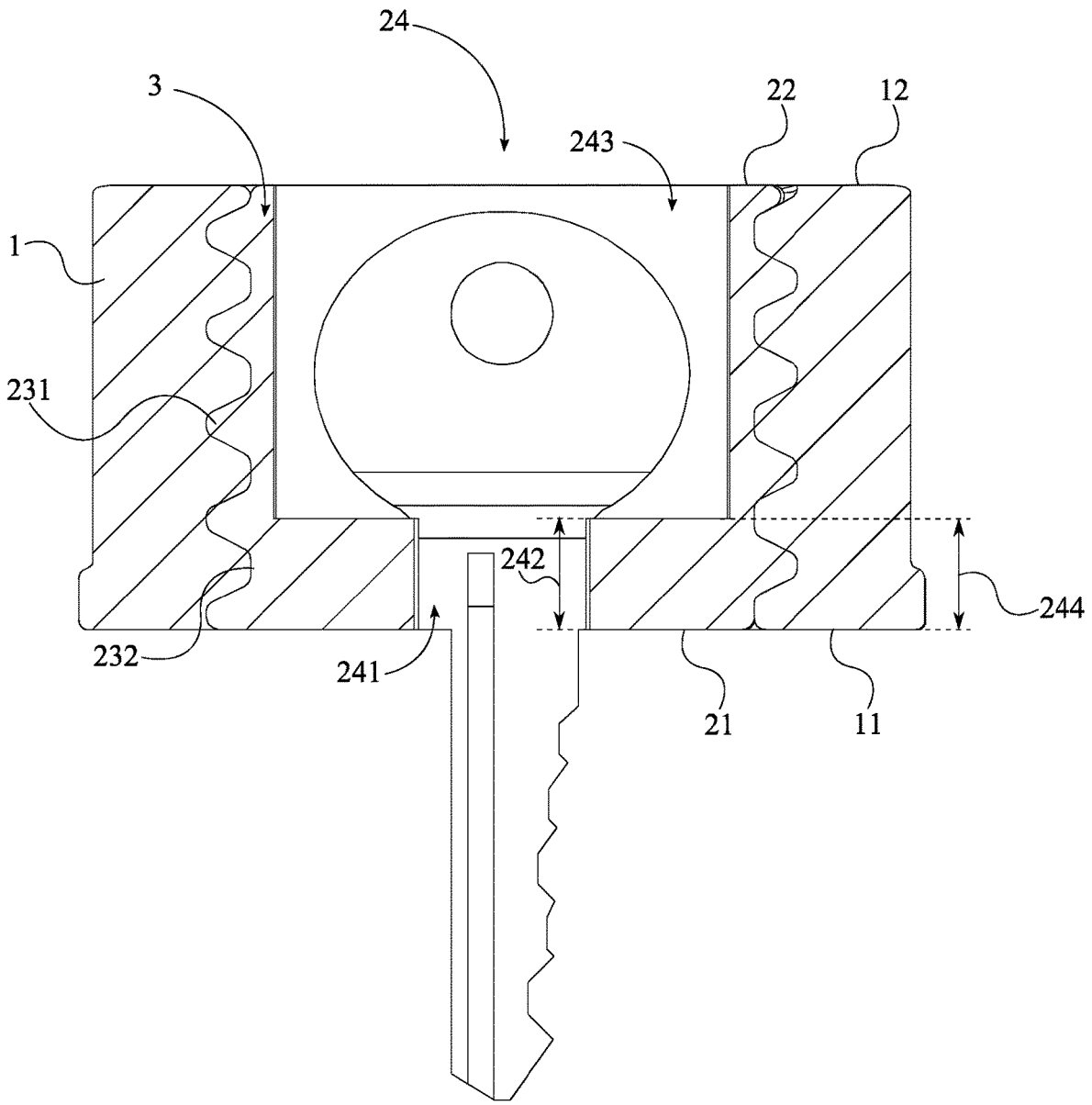
FIG. 5A is a side cross section view taken along line 5-5 in FIG. 4, showing the depth of shoulder slot being equal to the specified key shoulder length.

Referring to FIG. 3 and FIG. 5A, in the preferred embodiment, the key slot 24 comprises a shoulder slot 241 and a head slot 243. Similarly, the threaded body 23 comprises a first end 231 and a second end 232. The first end 231 is adjacently connected to the second end 232. As such, the shoulder slot 241 traverses through the first end 231 from the interior face 21. Further, the head slot 243 traverses through the second end 232 from the exterior face 22. Finally, the shoulder slot 241 is positioned concentric with the head slot 243. This allows the key to be positioned in the center of the key slot 24.

In the preferred embodiment, the key rotor 2 and the rotor housing 1 are custom built for a specific type of key. Alternately, the dimensions of the key rotor 2 and the rotor housing 1 may vary for different types of keys. The key preferably comprises a blade which is inserted into the key hole. A shoulder portion of the key prevents the blade from going further into the key hole. The shoulder portion also positions the key so that the notches on the blade can engage the tumblers in the lock. Finally, a head portion is used as a handle which allows the user to hold the key. In the preferred implementation, the head portion is enclosed by the key slot 24 of the threaded body 23.

Referring more specifically to FIG. 5A, in the preferred embodiment, the key slot 24 must be deep enough to allow the blade to fully extend out of the threaded body 23 and engage the lock. For the invention to operate as designed, the blade must fully extend out of the shoulder slot 241. To achieve this, a depth 244 of the shoulder slot 241 is equal to a specified key shoulder length 242. The specified key shoulder length 242 is the length of the shoulder portion. As such, the specified key shoulder length 242 may change depending on the overall dimensions of the key that is utilized.

Figure 5B:
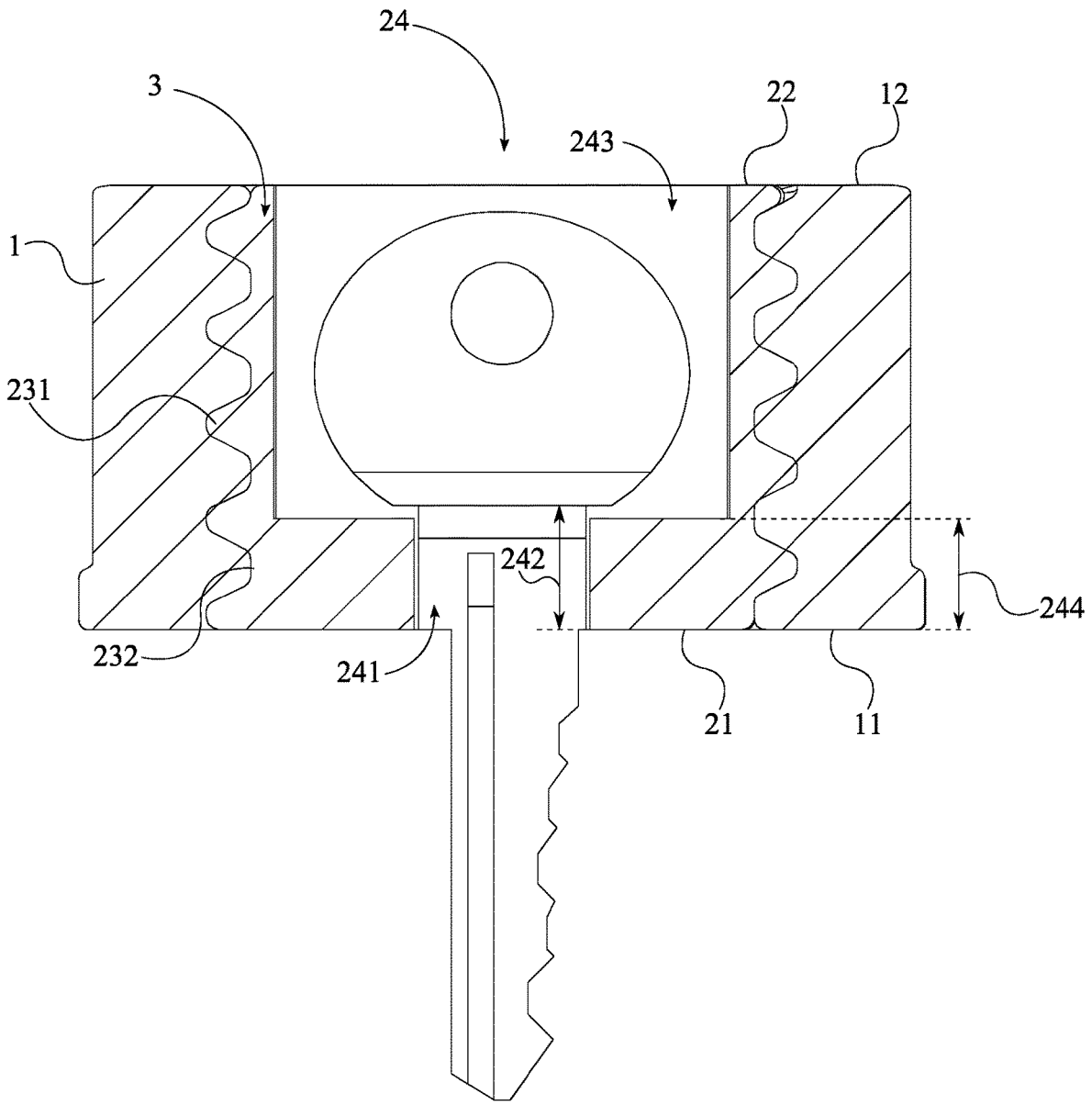
FIG. 5B is a side cross section view taken along line 5-5 in FIG. 4, showing the depth of shoulder slot being less than the specified key shoulder length.

Referring more specifically to FIG. 5B, in an alternate embodiment, the depth 244 of the shoulder slot 241 is smaller than the specified key shoulder length 242. Accordingly, the shoulder portion partially extends out of the shoulder slot 241. This still allows the blade to extend out of the key slot 24 and engage the tumbler in the lock, which is a necessary condition for the key to engage the lock.

In both embodiments, the shoulder portion is sized to fit tightly within the shoulder slot 241. This causes the head portion to press against the head slot 243 when the key is engaged to the lock. Further, this also acts as the principle mechanism for preventing the key from rotating back into a straight position.

As can be seen in FIG. 2 and FIG. 5A, in the preferred implementation of the present invention, the key is inserted and rotated to unlock the control box. Once the key is rotated to the unlocked position, the blade is fixed into position within the keyhole. Thus, the blade cannot be pulled out of the lock until the key is rotated back into the straight position. The present invention exploits this mechanism to prevent the from key rotating. When the key starts to rotate, the threaded body 23 also begins to rotate in relation to the rotor housing 1. Accordingly, the screw mechanism of the threaded opening 3 attempts to transform the rotational motion into a linear motion out of the rotor housing 1. However, since the blade is fixed into the keyhole, the key itself prevents the threaded body 23 from moving out of the rotor housing 1. More specifically, the head portion strikes against the head slot 243, and prevents further movement of the threaded body 23.

Conversely, to detach the key from the lock, the user must rotate the rotor housing 1 until the rotor housing 1 is no longer in contact with the control box. This allows threaded body 23 to freely rotate within the rotor housing 1 and reposition the key into a straight position.

As can be seen in FIG. 5A, in the preferred embodiment, the head portion is completely enclosed in the head slot 243. This allows the user to hold the threaded body 23 while the key is in the key slot 24. Alternately, the key may be engaged in a manner which exposes the head portion out of the key slot 24. This allows the user to detach the key from the threaded body 23 without removing the key from the key slot 24.

Referring back to FIG. 1 and FIG. 2, finally, the rotor housing 1 comprises an inner surface 11 and an outer surface 12. The inner surface 11 and the outer surface 12 are positioned opposite each other about the rotor housing 1. As the name implies, when the rotor housing 1 is engaged to the control box, the inner surface 11 faces towards the control box. Similarly, the outer surface 12 faces away from the control box when the rotor housing 1 is engaged to the control box. As such, the interior face 21 is positioned adjacent to the inner surface 11. Similarly, the exterior face 22 is positioned adjacent to the outer face 12. This ensures that the key slot 24 is always away from the control box and ready to accept the key.

Although the invention has been explained in relation to its preferred embodiment, it is to be understood that many other possible modifications and variations can be made without departing from the spirit and scope of the invention as hereinafter claimed.

What is claimed is:

1. A key holder designed for use with manual key switches comprises:

a rotor housing;

a key rotor;

a threaded opening;

the key rotor comprises an interior face, an exterior face, a threaded body, and a key slot;

the interior face and exterior face being positioned opposite each other about the threaded body;

the key slot concentrically traversing through the threaded body from the exterior face to the interior face;

the threaded opening concentrically traversing through the rotor housing; and the threaded body being rotatably engaged within the threaded opening.

2. The key holder designed for use with manual key switches as claimed in claim 1 comprises:

a first finger slot;

a second finger slot;

the first finger slot laterally traversing into the threaded body from the exterior face;

the second finger slot laterally traversing into the threaded body from the exterior face; and the first finger slot and the second finger slot being diametrically opposed of each other about the key slot.

3. The key holder designed for use with manual key switches as claimed in claim 1 comprises:

the key slot comprises a shoulder slot and a head slot;

the threaded body comprises a first end and a second end;

the first end being adjacently connected to the second end;

the shoulder slot traversing through the first end from the interior face;

the head slot traversing through the second end from the exterior face; and the shoulder slot being positioned concentric with the head slot.

4. The key holder designed for use with manual key switches as claimed in claim 3, wherein a depth of the shoulder slot is equal to a specified key shoulder length.

5. The key holder designed for use with manual key switches as claimed in claim 3, wherein a depth of the shoulder slot is smaller than a specified key shoulder length.

6. The key holder designed for use with manual key switches as claimed in claim 1 comprises:

a plurality of grooves;

the plurality of grooves being radially positioned about the rotor housing; and the plurality of grooves laterally traversing into the rotor housing.

7. The key holder designed for use with manual key switches as claimed in claim 1 comprises:

the rotor housing comprises an inner surface and an outer surface;

the inner surface and the outer surface being positioned opposite each other about the rotor housing;

the interior face being positioned adjacent to the inner surface; and the exterior face being positioned adjacent to the outer surface.

8. A key holder designed for use with manual key switches comprises:

a rotor housing;

a key rotor;

a threaded opening;

the key rotor comprises an interior face, an exterior face, a threaded body, and a key slot;

the key slot comprises a shoulder slot and a head slot;

the threaded body comprises a first end and a second end;

the interior face and exterior face being positioned opposite each other about the threaded body;

the key slot concentrically traversing through the threaded body from the exterior face to the interior face;

the threaded opening concentrically traversing through the rotor housing;

the threaded body being rotatably engaged within the threaded opening;

the first end being adjacently connected to the second end;

the shoulder slot traversing through the first end from the interior face;

the head slot traversing through the second end from the exterior face; and the shoulder slot being positioned concentric with the head slot.

9. The key holder designed for use with manual key switches as claimed in claim 8, wherein a depth of the shoulder slot is equal to a specified key shoulder length.

10. The key holder designed for use with manual key switches as claimed in claim 8, wherein a depth of the shoulder slot is smaller than a specified key shoulder length.

11. The key holder designed for use with manual key switches as claimed in claim 8 comprises:

a plurality of grooves;

the plurality of grooves being radially positioned about the rotor housing; and the plurality of grooves laterally traversing into the rotor housing.

12. The key holder designed for use with manual key switches as claimed in claim 8 comprises:

the rotor housing comprises an inner surface and an outer surface;

the inner surface and the outer surface being positioned opposite each other about the rotor housing;

the interior face being positioned adjacent to the inner surface; and the exterior face being positioned adjacent to the outer surface.

13. A key holder designed for use with manual key switches comprises:

a rotor housing;

a key rotor;

a threaded opening;

a plurality of grooves;

the key rotor comprises an interior face, an exterior face, a threaded body, and a key slot;

the key slot comprises a shoulder slot and a head slot;

the threaded body comprises a first end and a second end;

the interior face and exterior face being positioned opposite each other about the threaded body;

the key slot concentrically traversing through the threaded body from the exterior face to the interior face;

the threaded opening concentrically traversing through the rotor housing;

the threaded body being rotatably engaged within the threaded opening;

the first end being adjacently connected to the second end;

the shoulder slot traversing through the first end from the interior face;

the head slot traversing through the second end from the exterior face;

the shoulder slot being positioned concentric with the head slot;

the plurality of grooves being radially positioned about the rotor housing; and the plurality of grooves laterally traversing into the rotor housing.

14. The key holder designed for use with manual key switches as claimed in claim 13, wherein a depth of the shoulder slot is equal to a specified key shoulder length.

15. The key holder designed for use with manual key switches as claimed in claim 13, wherein a depth of the shoulder slot is smaller than a specified key shoulder length.

16. The key holder designed for use with manual key switches as claimed in claim 13 comprises:

the rotor housing comprises an inner surface and an outer surface;

the inner surface and the outer surface being positioned opposite each other about the rotor housing;

the interior face being positioned adjacent to the inner surface; and the exterior face being positioned adjacent to the outer surface.

* * * * *